US005354141A

United States Patent [19]

Watanabe

[11] Patent Number: 5,354,141

[45] Date of Patent: Oct. 11, 1994

[54] MECHANICAL PENCIL WITH SHAKING TYPE LEAD-FEEDING MECHANISM

[75] Inventor: Hiroyuki Watanabe, Hiratsuka, Japan

[73] Assignee: Pilot Precision Kabushiki Kaisha, Kanagawa, Japan

[21] Appl. No.: 946,292

[22] PCT Filed: Mar. 4, 1992

[86] PCT No.: PCT/JP92/00255

§ 371 Date: Nov. 3, 1992

§ 102(e) Date: Nov. 3, 1992

[87] PCT Pub. No.: WO92/15462

PCT Pub. Date: Sep. 17, 1992

[30] Foreign Application Priority Data

| | | | |
|---|---|---|---|
| Mar. 4, 1991 | [JP] | Japan | 3-18730 |
| Mar. 6, 1991 | [JP] | Japan | 3-19647 |
| Mar. 11, 1991 | [JP] | Japan | 3-21359 |
| Mar. 11, 1991 | [JP] | Japan | 3-70623 |
| Mar. 29, 1991 | [JP] | Japan | 3-28751 |
| Jun. 13, 1991 | [JP] | Japan | 3-53041 |

[51] Int. Cl.[5] ..... B43K 21/16; B43K 29/02

[52] U.S. Cl. ..... 401/65; 401/82; 401/94; 401/115

[58] Field of Search ..... 401/65, 67, 94, 80–82, 401/85, 89, 93, 29, 115

[56] References Cited

U.S. PATENT DOCUMENTS

| | | | |
|---|---|---|---|
| 4,205,924 | 6/1980 | Sumita | 401/67 X |
| 4,352,580 | 10/1982 | Ando | 401/82 X |
| 4,619,539 | 10/1986 | Kageyama | 401/65 X |
| 4,929,107 | 5/1990 | Kageyama et al. | 401/115 X |

FOREIGN PATENT DOCUMENTS

| | | | |
|---|---|---|---|
| 145232 | 11/1976 | Japan | 401/52 |
| 171576 | 12/1980 | Japan | 401/65 |
| 121587 | 7/1982 | Japan | 401/65 |
| 83585 | 6/1984 | Japan | 401/59 |
| 51782 | 4/1988 | Japan | 401/65 |
| 292098 | 12/1990 | Japan | 401/65 |

*Primary Examiner*—Danton D. DeMille

*Attorney, Agent, or Firm*—Wenderoth, Lind & Ponack

[57] ABSTRACT

A longitudinal opening window (1B) is formed a: a rear end portion of a cylindrical casing (1) of a mechanical pencil. At the rear end of the cylindrical casing (1), an eraser holder (12) is disposed in such a way that it can move forward and rearward for a predetermined distance. At the rear end of the eraser holder (12), a rubber eraser (13) is mounted. At the front of the eraser holder (12), a cylindrical small diameter front portion (12B) is provided. On the outside of the small diameter front portion (12B) is disposed a stop portion (12D) protruding outwardly on a resilient piece (12C). The stop portion (12D) engages with the opening window (1B). The rear end of a lead reservoir (10) connected to the rear portion of a chuck (7) extends to the inside of the small diameter front portion (12B). When the cylindrical casing (1) is shaken, a weight (11) surrounding the lead reservoir (10) moves forward, thereby causing the chuck (7) to move forward. When the weight is moved rearward due to the reaction, it collides with the front end of the small diameter front portion (12B), thereby causing the eraser holder (12) to move rearward. Thus, the shock of the rearward movement of the weight (11) is not applied to other than the eraser holder (12).

9 Claims, 10 Drawing Sheets

MECHANICAL PENCIL WITH SHAKING TYPE LEAD-FEEDING MECHANISM

BACLGRPIMD OF THE INVENTION

1. Field of the Invention

The present invention relates to a mechanical pencil with a shaking type lead-feeding mechanism for forwardly moving a lead holding chuck with an inertial force of a weight upon shaking a cylindrical casing so as to feed a pencil lead.

2. Background Art

In the above-mentioned type of mechanical pencil, a weight is disposed in a cylindrical casing thereof in such a way that the weight reciprocally is movable in the longitudinal direction of the cylindrical casing. When the casing is shaken in the longitudinal direction thereof, the weight is quickly moved toward a writing point. With an inertial force of the weight, a lead holding chuck is moved toward the writing point against the resilient force of a spring. Thus, the pencil lead is fed. In this type of mechanical pencil, a shoulder portion with which the weight collides and comes in contact is disposed on the chuck side. In addition, this mechanical pencil is provided with a stopper which prevents the weight from dropping out of the rear end of the cylindrical casing upon a rearward motion of the weight due to a reaction to the forward motion thereof. This stopper is formed as an outer collar on a cylindrical lead reservoir connected to the rear portion of the lead holding chuck. The stopper limits the rearward movement of the ring-shaped weight slidably mounted on the outer surface of the lead reservoir.

However, in the conventional mechanical pencil with the shaking type lead-feeding mechanism, whenever the weight moves rearward and comes in contact with the stopper, the lead reservoir also moves rearward due to a rearward shock applied thereto. Thus, the chuck also moves rearward. At this time, the chuck is closed instantaneously by a tightening ring. As a result, the pencil lead in the chuck is sometimes damaged or broken thereby.

Moreover, this type of mechanical pencil is also provided with a knock member at the rear end of the cylindrical casing so as to supply pencil leads and feed the pencil lead being chucked. When a rubber eraser is mounted on the knock member, and the eraser is used, the chuck is moved forward whereby the pencil lead is fed. To solve this problem, the knock member should be urged by a spring with a relatively strong resilient force in the longitudinally rearward direction of the casing.

However, this mechanical pencil has a large number of parts. In addition, since the mechanical pencil should be assembled in a state where the spring is compressed, productivity in the manufacture of the mechanical pencil is low, whereby the manufacturing cost thereof is high. Moreover, when the knock member is to be knocked to feed the lead, the spring with the relatively strong resilient force should be compressed by the knock member. Therefore, the finger of the user for knocking the knock member sometimes hurts. On the other hand, when the eraser is part of the knock member, if a short eraser floats from the bottom of the hole of an eraser holder, the eraser may sink into the eraser holder.

SUMMARY OF THE INVENTION

An object of the present invention is to provide a mechanical pencil with a shaking type lead-feeding mechanism in which the rearward motion of the weight neither causes the chuck to damage or break a pencil lead therein, nor requires a strong force for the operation of the knock member.

To achieve this object, a mechanical pencil having a shaking type lead-feeding mechanism, according to the present invention, comprises a cylindrical casing having a front end portion for writing and a rear end portion, a lead holding chuck disposed in the cylindrical casing adjacent to the front end portion, a lead reservoir connected to a rear portion of the lead holding chuck for storing a pencil lead to be fed to the chuck, a weight reciprocally movable in a longitudinal direction of the cylindrical casing along the lead reservoir, for applying an inertial force to the chuck when the cylindrical casing is shaken, the inertial force causing the chuck to feed the pencil lead, and a knock member disposed at the rear end portion of the cylindrical casing, the improvement comprising a cylindrical portion protruding forward from the knock member and fitted in the rear end portion of the casing, the cylindrical portion being slidable in the longitudinal direction of the casing, engaging means disposed adjacent to the rear end portion of the casing, and a stop portion disposed on the cylindrical portion and engaging the engaging means, the stop portion being movable over a predetermined distance in the longitudinal direction of the casing so that the knock member is slidable in the longitudinal direction of the casing, the front end of the cylindrical portion being opposed to the rear end of the weight in the longitudinal direction of the casing so as to be capable of contacting the rear end of the weight.

BEST MODE FOR CARRYING OUT THE INVENTION

Figure 1:
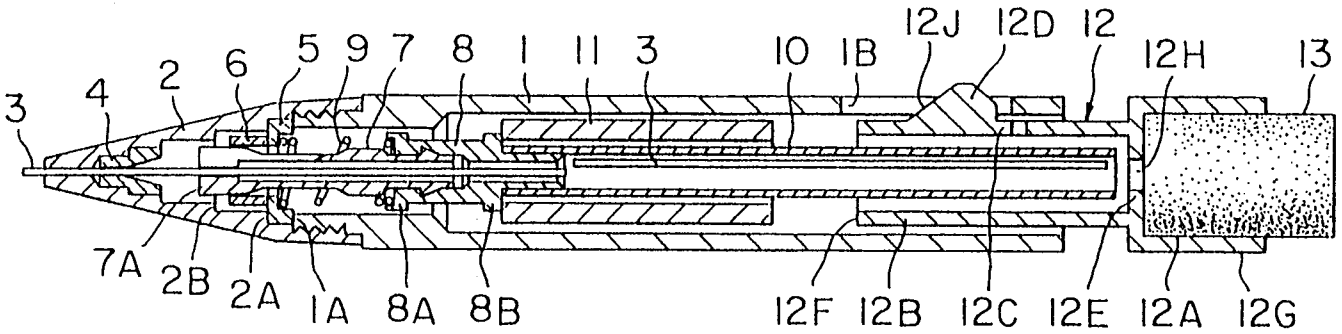
FIG. 1 is a longitudinal sectional view of an embodiment of the present invention.
Figure 2:
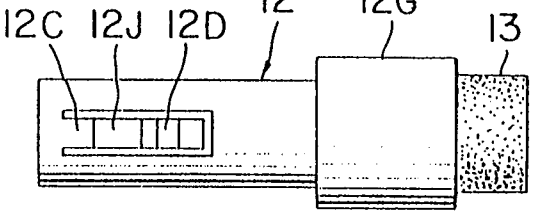
FIG. 2 is a plan view of an eraser holder of the embodiment of FIG. 1.
Figure 3:
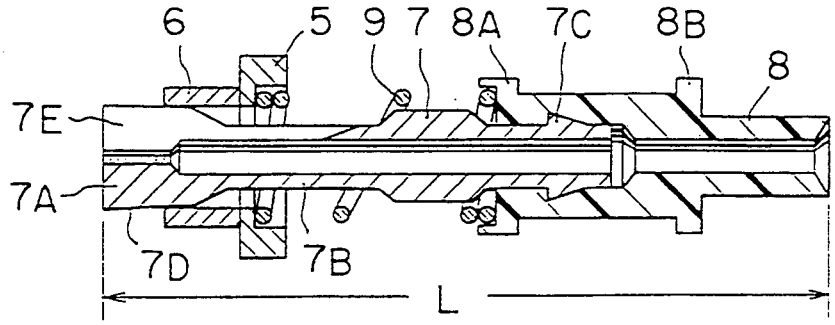
FIG. 3 is an enlarged sectional view of a chuck shown in FIG. 1.

FIGS. 1, 2 and 3 show an embodiment of the present invention. A mouth ring 2 is screwed to the front of a cylindrical casing 1. In the mouth ring 2, a lead holder 4 which lightly holds a pencil lead 3 is provided. A washer 5 is securely held between an inner shoulder 2A of the mouth ring 2 and a front end 1A of the cylindrical casing 1. A tightening ring 6 is movably provided between the washer 5 and an abutment shoulder 2B of the mouth ring 2. A front end head portion 7A of a lead holding chuck 7 made of a metal is inserted into the tightening ring 6.

As shown in FIG. 3, the head portion 7A of the chuck 7 has a tapered outer surface 7D and is divided by a longitudinal slit 7E. A connector 8 made of a synthetic resin is securely connected to the rear of the chuck 7. A chuck spring 9 which has a relatively weak resilient force is tensioned between the washer 5 and an outer collar 8A at the front end of the connector 8. The chuck 7 is normally pressed rearward with the resilient force of the chuck spring 9. The head portion 7A of the chuck is pushed into the tightening ring 6. Thus, the head portion 7A is closed and holds the pencil lead 3. At the rear of the chuck 7, a protrusion 7C is formed. The front surface of the protrusion 7C is perpendicular to the longitudinal direction of the cylindrical casing 1, the rear surface thereof being oblique. The rear portion of the chuck 7 is pressure-inserted into an inner hole disposed at the front of the connector 8. When the chuck 7 is pressure-inserted into the connector 8, the chuck 7 is positioned so that the length L from the front end of the chuck 7 to the rear end of the connector 8 becomes a predetermined value. As shown in FIG. 1, the rear end of the connector 8 is connected to a cylindrical lead reservoir 10 for storing leads. A weight 11 is mounted on the lead reservoir 10 in a such a way that the weight 11 can move in the longitudinal direction of the lead reservoir 10. The connector 8 and the lead reservoir 10 may be integrally formed of the same material.

An eraser holder 12 which holds a rubber eraser 13 in a rear hole 12A thereof is disposed at the rear end of the cylindrical casing 1. This eraser holder 12 and the rubber eraser 13 constitute a knock member. At a cylindrical small-diameter front portion 12B of the eraser holder 12, a resilient piece 12C is formed by a U-shaped cutout as shown in FIG. 2. On the resilient piece 12C is formed a stop portion 12D protruding in the radial direction thereof. The middle of the stop portion 12D in the longitudinal direction thereof is most protruded. The most protruded portion of the stop portion 12D is protruded out of the cylindrical casing 1. The front of the stop portion 12D has an oblique surface 12J. The small-diameter front portion 12B of the eraser holder 12 is inserted in the rear end of the cylindrical casing 1. The stop portion 12D of the eraser holder 12 is mounted in an opening 1B as an engagement means formed at the rear of the cylindrical casing 1 in such a way that the stop portion 12D can move in the longitudinal direction of the cylindrical casing 1 by an appropriate distance. The cylindrical casing 1 is adapted to abut against the rear end surface of the stop portion 12D of the eraser holder 12 at the rear end of the opening 1B. Thus, the eraser holder 12 does not fall out of the rear end of the cylindrical casing 1. As a result, the weight 1 can slide between an outer collar 8B of the connector 8 and the eraser holder 12 in the longitudinal direction of the cylindrical casing 1. Although the rear end of the lead reservoir 10 is shown as being spaced from an inner collar 12E of the eraser holder 12, they can be connected to or slightly separated from each other.

In this embodiment, to feed the pencil lead 3, the cylindrical casing 1 is shaken whereby an inertial force is produced. Thus, the weight 11 is moved forward and thus the weight 11 comes in contact with the outer collar 8B of the connector 8. As a result, the inertial force of the weight 11 causes the chuck spring 9 to be compressed, moving the chuck 7 forward and feeding the pencil lead 3. When the weight 11 comes in contact with the connector 8, the weight will be moved back rearwardly due to a reaction force of the spring 9 and comes in contact with the front end 12F of the eraser holder 12. However, since the stop portion 12D of the eraser holder 12 collides with and stops at the edge of the casing 1 defining the rear of the opening 1B, the eraser holder 12 supports the weight 11 without allowing it to fall rearwardly out of the cylindrical casing 1. At this time, the eraser holder 12 slides rearward until the stop portion 12D thereof comes in contact with the edge of the casing defining the rear end of the opening 1B. In this manner, the eraser holder 12 performs a cushioning action.

When the user uses rubber eraser 13, he will hold a rear large diameter portion 12G of the eraser holder 12 with his hand and then perform an erasing action. Because the erasing operation with the rubber eraser 13 does not cause the chuck 7 to move forward, the pencil lead 3 is not fed. To supply pencil leads 3 in the lead reservoir 10, the user will remove the rubber eraser 13 and then supply the pencil leads 3 into the lead reservoir 10 through a through-hole 12H of the eraser holder 12. Alternatively, the user will push the stop portion 12D in the radially inner direction of the cylindrical casing 1, remove the eraser holder 12 rearward from the cylindrical casing 1, remove the eraser holder 12 rearward from the cylindrical casing 1, and supply the pencil leads 3 from the rear end of the lead reservoir 10. When the user reinserts the eraser holder 12 into the cylindrical casing 1, the oblique surface 12J guides the eraser holder for smooth reinsertion. To feed a new pencil lead 3 after a pencil lead 3 has been consumed, when the rubber eraser 13 forming the knock member is depressed, the stop portion 12D of the rubber holder 12 is moved in the opening window 1B of the cylindrical casing 1. Thus, the inner collar 12E of the eraser holder 12 comes in contact with the rear end of the lead reservoir 10. Consequently, the lead reservoir 10 and the chuck 7 also move forward along with the eraser holder 12. Thus, the chuck 7 is opened. As a result, as in the conventional mechanical pencil with a shaking type lead-feeding mechanism, the new pencil lead 3 follows the old one.

Figure 8:
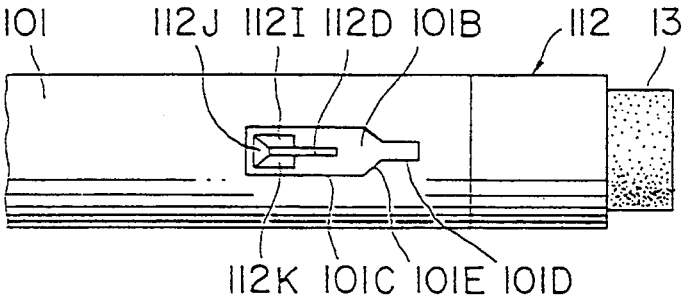
FIG. 8 is a plan view of part of the embodiment of FIG. 5 including the eraser holder.

Next, with reference to FIGS. 4, 5, 6, 7, and 8, another embodiment in which an eraser holder constituting a knock member is supported by a cylindrical casing will be described. In this embodiment, an opening window 101B formed at the rear of the cylindrical casing 101 has a large width portion 101C and a small width portion 101D disposed at the rear thereof as shown in FIG. 5. The large width portion 101C and the small width portion 101D are connected via an oblique portion 101E. In addition, a protrusion 112I and a thin stop portion 112D are formed on a resilient piece 112C of the eraser holder 112. The front end of the protrusion 112I has an oblique surface, the protrusion 112I having a uniform height in the longitudinal direction thereof. The thin stop portion 112D extends rearward from the protrusion 112I. However, the protrusion 112I and the stop portion 112D do not protrude from the outer surface of the cylindrical casing 101. In addition, the protrusion 112I has an oblique side surface 112K. The protrusion 112I has an oblique side surface 112K. The protrusion 112I of the eraser holder 12 is inserted into the large width portion 101C of the opening 101B of the cylindrical casing 101. The stop portion 112D of the eraser holder 112 is inserted into the small width portion 101D of the opening 101B. The eraser holder 112 is slidable longitudinally by a predetermined distance in the cylindrical casing 101. In addition, since the stop portion 112D of the eraser holder 112 collides with and stops at the edge of the casing defining the rear end of the opening 101B, the eraser holder 112 will not fall rearwardly out of the cylindrical casing 101. Thus, in the normal condition, even if a force is applied to the eraser holder 112 in the rotational direction thereof, the eraser holder 112 in the rotational direction thereof, the eraser holder 112 does not rotate since the stop portion 112D comes in contact with that portion of the casing defining the small width portion 101D. However, when the eraser holder 112 is moved forward while pushing the lead reservoir 10 against the force of a chuck spring, the stop portion 112D is moved into the large width portion 101C of the opening 101B as shown in FIG. 8. In this state, when a force is applied to the eraser holder 112 in the circumferencial direction thereof, the side oblique surface 11k of the protrusion 112I comes in contact with the edge of the casing defining the side of the large width portion 101C. Then, the resilient piece 112C of the eraser holder 112 is resiliently moved inward whereby the stop portion 112D is moved inwardly of the inner surface of the cylindrical casing 101. When the eraser holder 112 is rotated thereafter, the protrusion 112I and the stop portion 112D are moved out of the opening 101B and are located in the cylindrical casing 101. In this state, when the eraser holder 112 is pulled rearward, it can be easily removed from the cylindrical casing 101.

Figure 9:
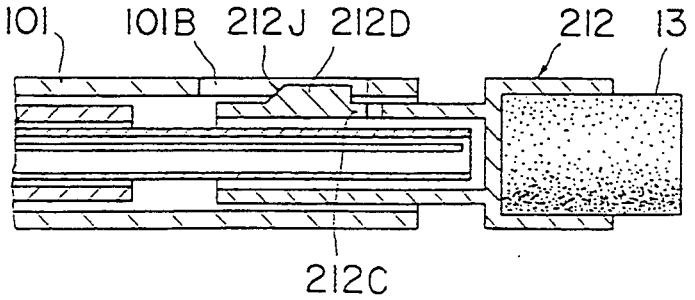
FIG. 9 is a sectional view of part of a further embodiment of the present invention.
Figure 10:
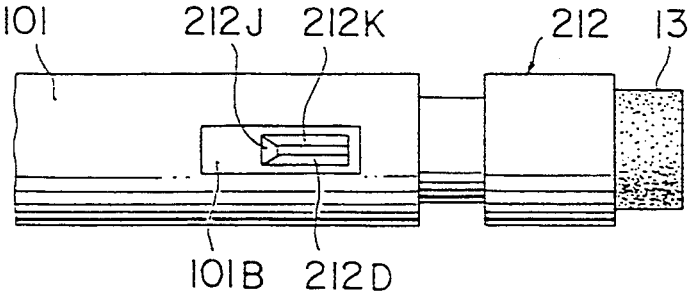
FIG. 10 is a plan view of the eraser holder of FIG. 9.

FIGS. 9 and 10 show another embodiment of the present invention. In this embodiment, a stop portion 212D having a uniform height in the longitudinal direction thereof is formed on a resilient piece 212C of an eraser holder 212 constituting a knock member. The stop portion 212D is inserted into the opening 101B of the cylindrical casing 101 in such a way that the stop portion 212D is slidable longitudinally of the cylindrical casing 101. The stop potion 212D does not reach the outer surface of the cylindrical casing 101. The stop portion 212D has side oblique surfaces 212K. With this structure, when the eraser holder 212 is rotated, since the side oblique surface 212K causes the resilient piece 212C to be resiliently moved inwardly in the radial direction of the cylindrical casing 101, the eraser holder 212 can be easily removed rearwardly from within the cylindrical casing 101.

Figure 4:
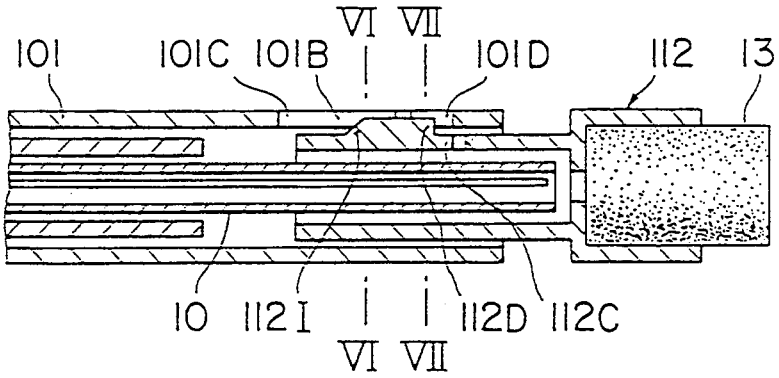
FIG. 4 is a partial sectional view of another embodiment of the present invention.
Figure 5:
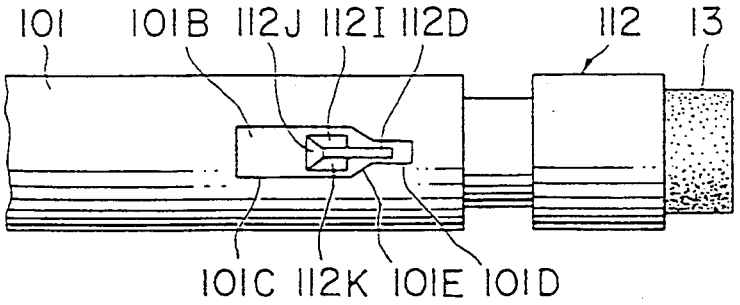
FIG. 5 is a plan view of FIG. 4.
Figure 6:
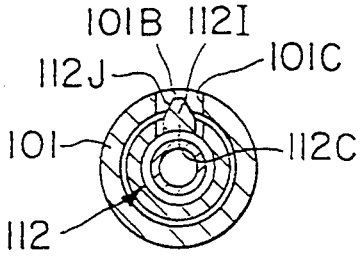
FIG. 6 is a sectional view taken along line VI—VI of FIG. 4.
Figure 7:
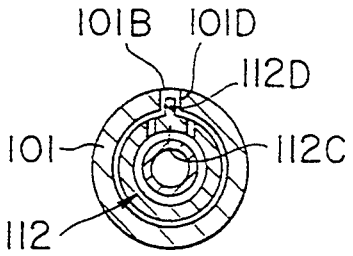
FIG. 7 is a sectional view taken along line VII—VII of FIG. 4.

In the above-mentioned embodiments shown in FIGS. 4 and 9, since the eraser holder can be easily removed from the cylindrical casing, pencil leads can be easily supplied to the lead reservoir.

Figure 11:
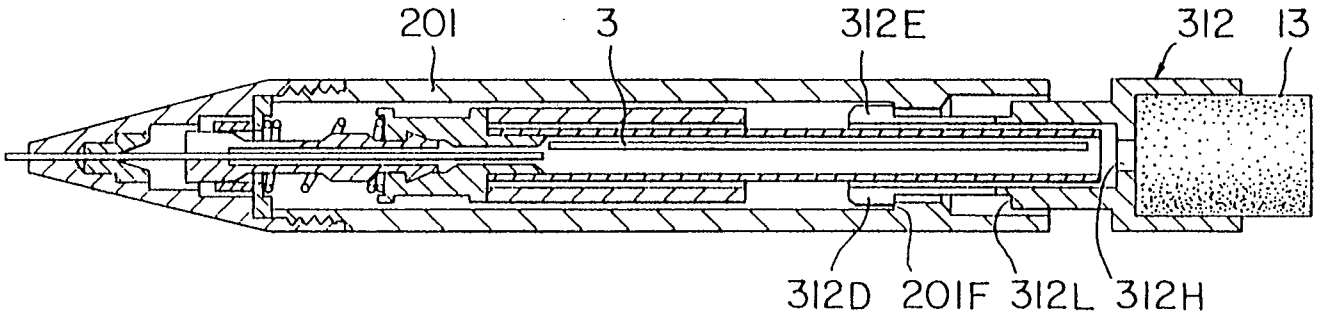
FIG. 11 is a sectional view of another embodiment of the present invention.

FIG. 11 shows another embodiment in which an eraser holder constituting a knock member is mounted to a cylindrical casing. As inner shoulder 201F as an engagement means is formed at the rear of a cylindrical casing 201. In addition, a stop portion 312D in the form of an outwardly extending flange is formed at the front of an eraser holder 312. The stop portion 312D is divided into several portions by grooves 312E extending in the longitudinal direction of the cylindrical casing 201 so as to allow the stop portion 312D to have a resiliency. A contact shoulder portion 312L is formed midway on the eraser holder 312. The stop portion 312D of the eraser holder 312 is inserted into the rear end of the cylindrical casing 201 so that the stop portion 312D rides over the inner shoulder 201F. Thus, the stop portion 312D, the contact shoulder portion 312L, and the inner shoulder 201F are capable of longitudinally abutting against each other. The eraser holder 312 is mounted to the cylindrical casing 201 in such a way that the eraser holder 312 is slidable in the cylindrical casing 201 over a predetermined distance. With this structure, the eraser holder 312 cannot be removed from the cylindrical casing 201. Thus, when pencil leads 3 are to be supplied to the lead reservoir, the rubber eraser 13 is removed from the eraser holder 312 and then the pencil leads 3 are supplied through a through-hole 312H of the eraser holder 312.

Figure 12:
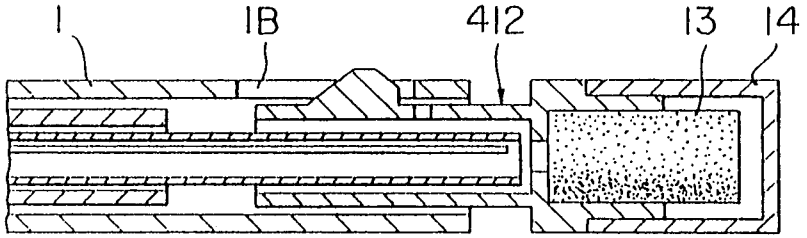
FIG. 12 is a sectional view of a further embodiment of the present invention.

Moreover, as in an embodiment shown in FIG. 12, the knock member can include a cap 14 serving as a knob mounted on an eraser holder 412 and covering the rubber eraser 13.

Figure 13:
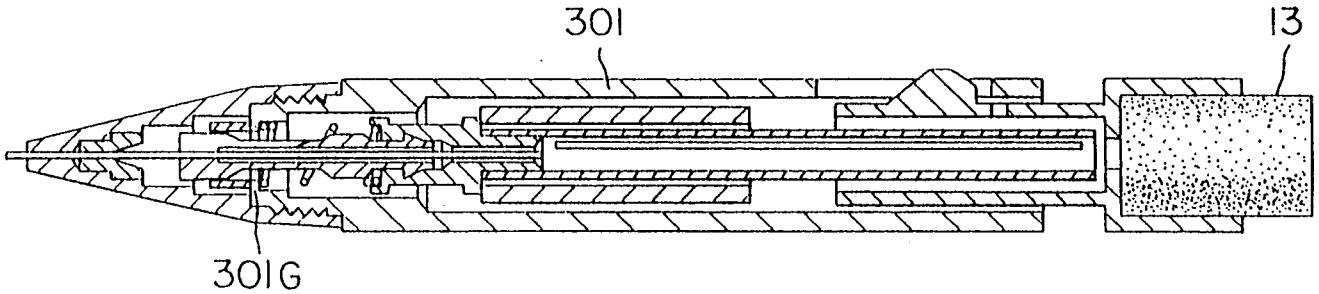
FIG. 13 is a sectional view of a further embodiment of the present invention.

It should be noted that the present invention is not limited to the lead feeding mechanism of the above-described embodiments. The present invention can be applied to a mechanical pencil in which a washer portion 301G is integrally formed at the front of a cylindrical casing 301 as shown in FIG. 13.

Figure 14:
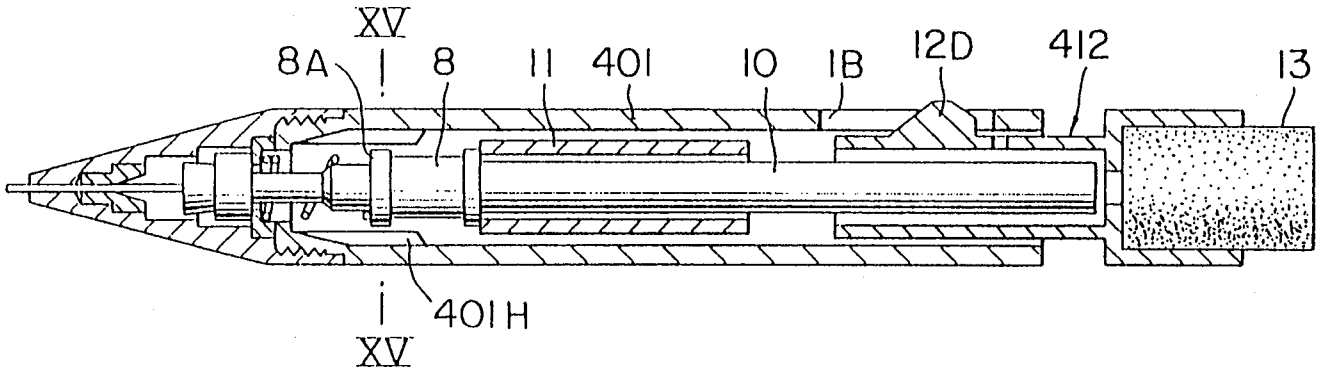
FIG. 14 is a sectional view of another embodiment of the present invention.
Figure 15:
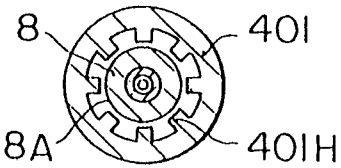
FIG. 15 is a sectional view taken along line XV—XV of FIG. 14.

In the above-described embodiments, the inner surface of the front end of the cylindrical casing causes the outer collar at the front end of the connector to be centered, thereby preventing deflection of the lead reservoir and the chuck. However, as shown in FIGS. 14 and 15, by providing longitudinal ribs 401H on the inner surface of the front of a cylindrical casing 401, the outer collar 8A at the front end of the connector can be centered.

In the above-described embodiments, the head portion of the knock member which is supported at the rear end of the cylindrical casing comprises the eraser holder and the rubber eraser held thereby. However, the head portion of the knock member can be a solid member which does not contain a rubber eraser as shown in FIGS. 16 to 19.

Figure 16:
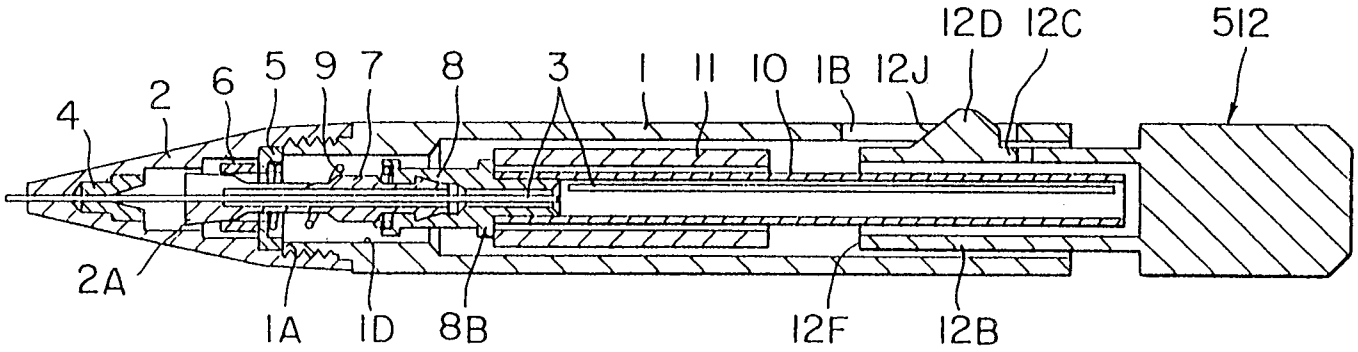
FIG. 16 is a sectional view of another embodiment of the present invention, having a knock member without an eraser.
Figure 17:
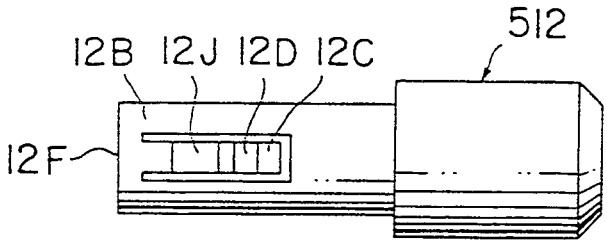
FIG. 17 is a plan view of the knock member of the embodiment of FIG. 16.

In the embodiment shown in FIGS. 16 and 17, the entire knock member is represented by reference numeral 512. The head portion of the knock member is solid. For example, the knock member 512 may be unitarily formed of a synthetic resin. The remainder of the embodiment shown in FIG. 16 is the same as that shown in FIG. 1. At the front of the knock member 512 is formed the cylindrical small-diameter front portion 12B. The stop portion 12D having the oblique surface 12J protrudes from the thin front portion 12B of the resilient piece. Other portions which are the same as those shown in FIG. 1 are represented with the same reference numerals. The description of the same portions will be omitted for the sake of brevity.

The mechanical pencils having the above-described shaking type lead-feeding mechanisms are assembled in the following manner. First, the lead reservoir 10 and the connector 8 which are the writing mechanism are inserted through the front hole 1D into the cylindrical casing 1. The mouth ring 2 is screwed to the front of the cylindrical casing 1. The washer 5 is securely held between the inner shoulder 2A of the mouth ring 2 and the front end 1A of the cylindrical casing 1. Thereafter, the weight 11 is inserted into the cylindrical casing 1 through the rear end thereof by sliding the weight 11 along the outer surface of the lead reservoir 10. Next, the stop portion 12D of the knock member 512 is inserted into the opening window 1B of the cylindrical casing 1. Thereafter, the knock member 512 is mounted to the rear of the cylindrical casing 1.

Figure 18:
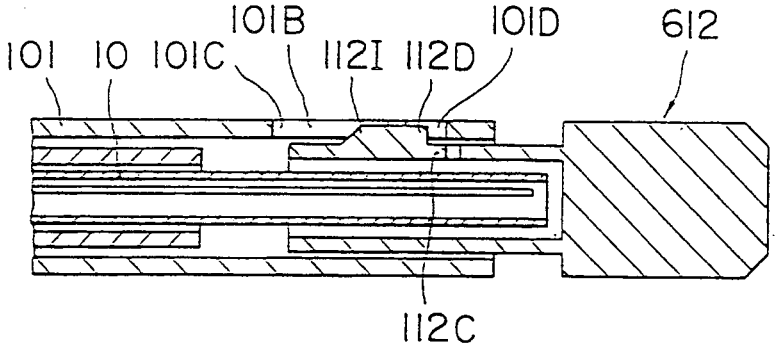
FIG. 18 is a sectional view of part of a further embodiment, having a knock member without an eraser, of the present invention.

In an embodiment shown in FIG. 18, a knock member 612 has a solid head portion. The remainder of the embodiment shown in FIG. 18 is the same as that shown in FIG. 4. The portions which are the same as those shown in FIG. 4 are represented by the same reference numerals. The description of the same portions will be omitted for the sake of brevity.

Figure 19:
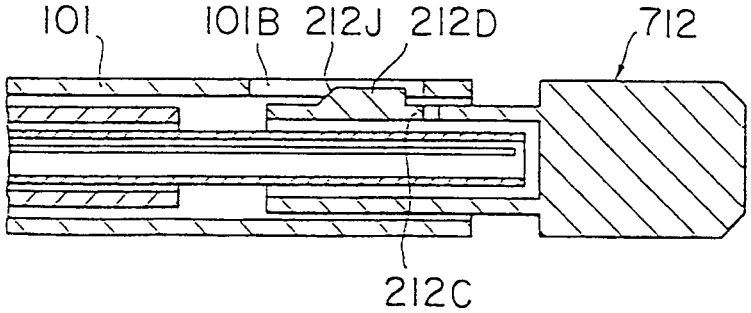
FIG. 19 is a sectional view of part of a further embodiment of the present invention.

In an embodiment shown in FIG. 19, the knock member 712 also has a solid head portion. The other portions of this embodiment are the same as those shown in FIG. 9 and will not be described but are designated by the same reference numerals.

Figure 20:
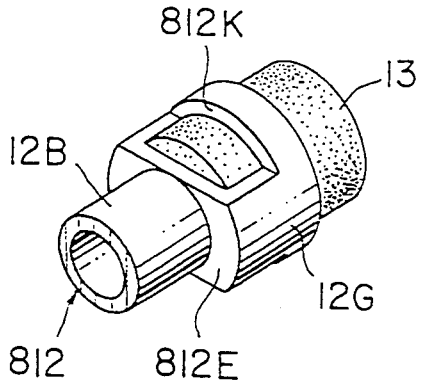
FIG. 20 is a perspective view of a modification of a knock member with an eraser.
Figure 21:
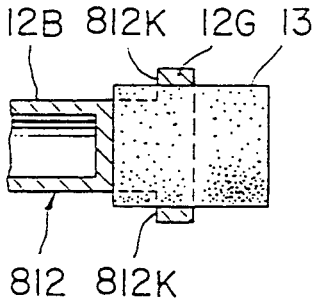
FIG. 21 is a sectional view of the knock member shown in FIG. 20.
Figure 22:
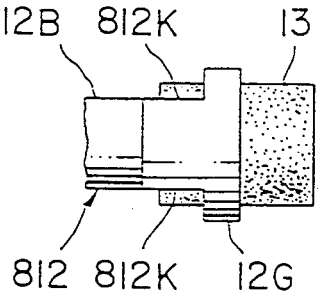
FIG. 22 is a rear view of the knock member shown in FIG. 20.

In an embodiment shown in FIGS. 20 to 22, like the embodiment shown in FIG. 1, a knock member comprises an eraser holder 812 and a rubber eraser 13. However, in the embodiment shown in these figures, an opening 812K is formed in the large-diameter portion 12G of the eraser holder 812 so as to extend from a bottom wall 812E to a peripheral wall thereof. The rubber eraser 13 is inserted into the large diameter portion 12G in such a way that the rubber eraser 13 comes in contact with the bottom wall 812E of the eraser holder 812. In this embodiment, when the eraser 13 wears to such a degree that it does not protrude from the eraser holder 812, the eraser can be removed by pushing the remaining portion thereof from the opening 812K of the eraser holder 812 with a finger of the user. Alternatively, it can be removed by sticking a needle or the like into the rubber eraser 13 through the window 812K and moving the rubber eraser 13 rearward.

Figure 23:
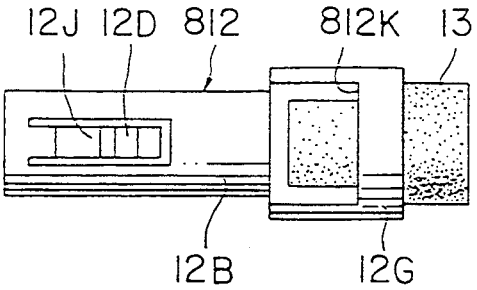
FIG. 23 is a plan view of the knock member shown in FIG. 20.

The eraser holder 812 can be used in the embodiments shown in FIGS. 1, 4, and 9. An example in which the eraser holder 812 is used in the embodiment of FIG. 1 is shown in FIG. 23.

Figure 24:
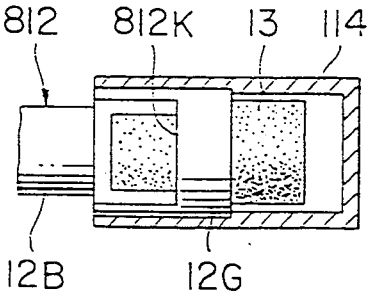
FIG. 24 is a sectional view of a further example of a knock member with an eraser.

In an example shown in FIG. 24, a cap 114 which covers the rubber eraser 13 is detachably mounted on the knock member shown in FIGS. 20 or 22. This cap 114 functions as knob as in the example shown in FIG. 12.

When a mechanical pencil is subjected to shocks during shipment, the weight and the associated members vibrate, thereby unnecessarily feeding the pencil lead. As a result, the pencil lead is sometimes broken. To solve this problem, the embodiments shown in FIGS. 25 to 27 can be used.

Figure 25:
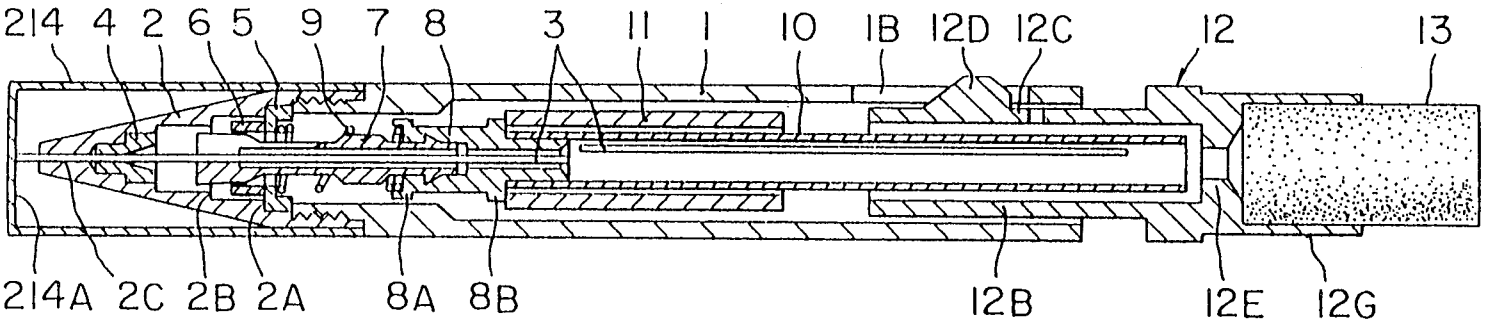
FIG. 25 is a sectional view of an embodiment having a detachable cap mounted on the front end of a cylindrical casing.
Figure 26:
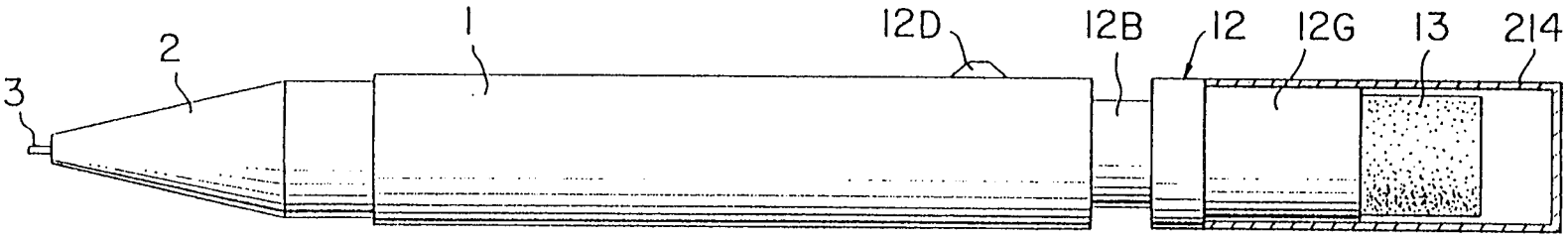
FIG. 26 is a plan view, partially in section, of the embodiment of FIG. 25 in a state in which a cap is mounted on the rear end of the cylindrical casing.

In the embodiment shown in FIG. 25, a cap is detachably mounted on the mouth ring 2 of the mechanical pencil. The bottom surface 214A of the cap 214 and the tip of the lead guide hole of the mouth ring 2 are spaced apart by approximately 2 mm. When the user wants to write with the mechanical pencil, he will remove the cap 214 from the mouth ring 2 and then fit it on the rear cylindrical portion 12G of the eraser holder 12 as indicated in FIG. 26.

Thus, when the mechanical pencil is delivered from a plant to a dealer, even if the mechanical pencil is subjected to shocks, the mechanical pencil can prevent the pencil lead from being unnecessarily fed since the pencil lead stays in contact with the bottom surface 214A of the cap 214. In addition, when the user carries the mechanical pencil, the feeding of pencil lead can also be prevented.

Figure 27:
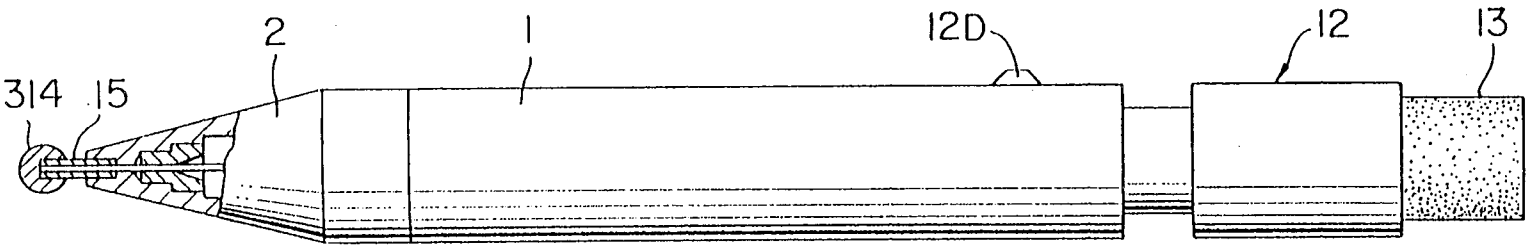
FIG. 27 is a partial sectional view of an embodiment which has a cap attachable to a writing point.

Instead of providing the cap 214, a disposable cap 314 may be mounted on a lead guide pipe 15 formed at the tip of the mouth ring 2 as shown in FIG. 27. In this embodiment, the user of this mechanical pencil will remove the cap 314 before using the mechanical pencil.

As described above, according to the present invention, when the casing of the mechanical pencil is shaken, the weight causes the chuck to feed the pencil lead. Thereafter, the weight moves rearward due to a reaction and collides with the front end of the cylindrical portion of the knock member. At this time, the knock member moves rearward over a predetermined distance in the longitudinal direction of the cylindrical casing so as to reduce the shock due to the collision. In addition, since the lead reservoir is not influenced by the rearward movement of the weight, the chuck does not move rearward. As a result, the pencil lead is not damaged or broken as a result of tightening by the chuck. Moreover, since the knock member is not urged rearward by a strong resilient force of a spring, a large force is not required for pushing the knock member.

Although the present invention has been described in detail above, various changes and modifications will become apparent to those of ordinary skill in the art. For example, the present invention can be applied to any mechanical pencil having a shaking type lead-feeding mechanism.

I claim:

1. A mechanical pencil comprising:

a cylindrical casing having a front end portion and a rear end portion, and an opening extending through the rear end portion of the casing in the longitudinal direction thereof;

a lead holding chuck disposed in said cylindrical casing adjacent said front end portion;

a tightening member disposed in the casing adjacent to said lead holding chuck and by which tightening member said chuck is opened when the chuck is in a first position so that lead held thereby can be fed and by which tightening member said chuck is closed to fix lead in place when the chuck is in a second position located rearwardly of said first position in the casing spring means disposed in said casing for resiliently urging said chuck rearward to said first position;

a lead reservoir connected to a rear portion of said lead holding chuck, said lead reservoir defining a chamber used to store a pencil lead to be fed to said chuck;

a weight reciprocally movable along said lead reservoir in the longitudinal direction of said casing so as to apply an inertial force to said chuck when said cylindrical casing is shaken, said inertial force acting in a direction extending from said second position to said first position, whereby when said casing is shaken hard enough said chuck is moved to said first position thereof by said weight; and a knock member disposed at said rear end portion of said cylindrical casing and freely slidable in said casing in said longitudinal direction between a first position and a second position in abutment against said lead reservoir, said knock member including a rear cylindrical portion, a front cylindrical portion protruding forward from said rear cylindrical portion and freely slidable in said rear end portion of the casing, said rear cylindrical portion having a larger outer diameter than said front cylindrical portion, an eraser fitted in said rear cylindrical portion and exposed rearwardly thereof, and a resilient member disposed on said front cylindrical portion and having a stop portion protruding radially outwardly from said front cylindrical portion into said opening in the rear end portion of said casing, said stop portion being freely movable over a predetermined distance in said longitudinal direction of the casing so as to allow said knock member to slide freely in the longitudinal direction, said front cylindrical portion having a recess therethrough which extends around and forms said resilient member having said stop portion, and said front cylindrical portion having a forward end which is in a longitudinally opposing relation to said weight, the weight being slidable into abutment with the forward end of the front cylindrical portion of said knock member.

2. The mechanical pencil as set forth in claim 1, wherein said recess in the front cylindrical portion of said knock member is U-shaped.

3. The mechanical pencil as set forth in claim 1, wherein said stop portion has a surface at the front thereof which is oblique with respect to the longitudinal direction of the casing.

4. The mechanical pencil as set forth in claim 1, wherein said stop portion has surfaces at both sides thereof which are oblique with respect to the circumferential direction of said cylindrical portion.

5. The mechanical pencil as set forth in claim 1, wherein said opening includes a large width portion and a small width portion, said large width portion being disposed to the front of said small width direction as taken in the longitudinal direction of the casing, and wherein said stop portion has a thin part at the rear thereof, said thin part being normally disposed within said small width portion and being movable into said large width portion.

6. The mechanical pencil as set forth in claim 1, wherein the front cylindrical portion of said knock member surrounds the outer periphery of said lead reservoir, and wherein said knock member has a contacting surface contacting the rear end of said lead reservoir when the knock member is knocked forward.

7. The mechanical pencil as set forth in claim 1, wherein said knock member has cap-shaped knob detachably mounted to the rear cylindrical portion thereof.

8. The mechanical pencil as set forth in claim 1, wherein said knock member has a second opening therethrough extending from the bottom of said large diameter portion and through the peripheral wall thereof, said rubber eraser being exposed at said second opening.

9. The mechanical pencil as set forth in claim 1, and further comprising a cap selectively mountable to the rear of said knock member and the front end of said cylindrical casing.

* * * * *